US011866943B2

(12) United States Patent
Thompson et al.

(10) Patent No.: US 11,866,943 B2
(45) Date of Patent: Jan. 9, 2024

(54) EMBER AND FLAME RESISTANT RESETTABLE AUTOMATIC SOFFIT VENT

(71) Applicant: BMIC LLC, Dallas, TX (US)

(72) Inventors: Brannon Scott Thompson, Castle Hayne, NC (US); Steven Vonderlehr Boehling, Wilmington, NC (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 17/901,264

(22) Filed: Sep. 1, 2022

(65) Prior Publication Data

US 2023/0073277 A1 Mar. 9, 2023

Related U.S. Application Data

(63) Continuation of application No. 16/420,423, filed on May 23, 2019, now Pat. No. 11,434,641.
(Continued)

(51) Int. Cl.
*E04D 13/152* (2006.01)
*E04B 1/94* (2006.01)
*F24F 11/35* (2018.01)

(52) U.S. Cl.
CPC ..... *E04D 13/152* (2013.01); *E04B 1/947* (2013.01); *F24F 11/35* (2018.01)

(58) Field of Classification Search
CPC ..... E04D 13/152; E04B 1/947; F24F 11/35; F24F 13/12
See application file for complete search history.

(56) References Cited

U.S. PATENT DOCUMENTS 2,718,187 A * 9/1955 Frisby ..... E04D 13/152 454/260
6,022,271 A * 2/2000 Biondo ..... A62C 2/242 454/369
(Continued)

FOREIGN PATENT DOCUMENTS

GB 2312842 A * 11/1997 ..... A62C 2/18
GB 2312842 A 11/1997
(Continued)

OTHER PUBLICATIONS

JP-2001020408-A Masaichi, Ise; Machine translation; Jan. 2001.*
(Continued)

*Primary Examiner* — Christine T Cajilig
(74) *Attorney, Agent, or Firm* — WOMBLE BOND DICKINSON (US) LLP

(57) ABSTRACT

An ember and flame resistant resettable automatic soffit vent includes a tray with ventilation openings formed in its floor. A mesh screen resides on the floor of the tray spanning the ventilation openings. A flat slide resides atop the screen and also has ventilation openings that match those of the tray. The slide has an open position wherein its ventilation openings align with those of the tray to allow airflow through the vent and a closed position wherein its ventilation openings are misaligned with the ventilation openings of the tray to close off airflow through the vent. The vent can be manually moved between its open and closed positions and one or more tension springs and a thermal link assembly cooperate to move the slide to its closed position if the vent is exposed to a high temperature cause by a fire very near a home. The vent also can be manually closed by a home-owner when a fire is threatening and then manually reopened when the fire threat passes without destroying the automatic closing feature of the vent.

21 Claims, 6 Drawing Sheets

Related U.S. Application Data

(60) Provisional application No. 62/684,504, filed on Jun. 13, 2018.

(56) References Cited

U.S. PATENT DOCUMENTS

| | | | | |
|---|---|---|---|---|
| 7,191,845 | B2 | 3/2007 | Loar | |
| 7,413,024 | B1 | 8/2008 | Simontacchi et al. | |
| 8,230,650 | B1 | 7/2012 | Stamps | |
| 11,434,641 | B2 | 9/2022 | Thompson et al. | |
| 2004/0123610 | A1* | 7/2004 | Nowak | F25D 17/045 62/187 |
| 2008/0220714 | A1 | 9/2008 | Caruso et al. | |
| 2008/0248739 | A1 | 10/2008 | Carlson et al. | |
| 2011/0042515 | A1 | 2/2011 | Schoke et al. | |
| 2011/0061318 | A1 | 3/2011 | August | |
| 2015/0047860 | A1* | 2/2015 | Rutherford | A62C 2/20 169/48 |
| 2015/0072610 | A1* | 3/2015 | Coles | F24F 13/12 454/324 |

FOREIGN PATENT DOCUMENTS

| | | | | |
|---|---|---|---|---|
| GB | 2577987 A | * | 4/2020 | A62C 2/20 |
| GB | 2577987 A | | 4/2020 | |
| JP | 2001020408 | | 1/2001 | |

OTHER PUBLICATIONS

Vulcan Vent Web Page; http://www.vulcantechnologies.com/; Vulcan Technologies—Fire Protection for Buildings & Hoes, Vulcan Vent; Feb. 23, 2018; pp. 1-2.

* cited by examiner

EMBER AND FLAME RESISTANT RESETTABLE AUTOMATIC SOFFIT VENT

REFERENCE TO RELATED APPLICATION

The present Patent Application is a continuation of previously filed, U.S. patent application Ser. No. 16/420,423, filed May 23, 2019, which claims priority to and the benefit of U.S. Provisional Application No. 62/684,504, filed Jun. 13, 2018.

INCORPORATION BY REFERENCE

The disclosures of U.S. patent application Ser. No. 16/420,423, filed May 23, 2019, and U.S. Provisional Patent Application No. 62/684,504, filed Jun. 13, 2018, are specifically incorporated by reference herein as if set forth in their entireties.

TECHNICAL FIELD

This disclosure relates generally to attic ventilation products and more specifically to soffit vents that close automatically when exposed to the heat of a flame to prevent embers and flames from entering the attic space of a structure.

BACKGROUND

Open soffit vents in a home allow ambient air to enter the attic space through the soffits to replace hot attic air that may exit the attic through a ridge vent or other roof vent structure. In fire-prone regions of the country, soffit vents can contribute to home fires by allowing blowing embers and/or flames of a brush or forest fire to enter an attic through the soffit vents. Closable soffit vents exist for use in these fire-prone areas. U.S. Pat. No. 10,054,330 for example discloses a soffit vent having a tray with ventilation openings formed therein. A steel slider is slidably disposed in the tray and also has ventilation openings formed therethrough. The slider can be slid in the tray from an open position wherein its ventilation openings align with those of the tray and a closed position wherein its ventilation openings are misaligned with the ventilation openings of the tray.

In the closed position of the slider, airflow through the soffit vent is closed off to prevent flames from entering the attic. A layer of fine mesh screen is mounted above the slider. The mesh screen prevents embers from nearby flames from entering the attic through the soffit vent, even when the slider is in its open position. The slider has a tab at one end that extends through a slot in an end wall of the tray. The tab can be moved manually by a homeowner toward and away from the tray to move the slider between its closed and open positions respectively. A shortcoming of this vent is that forest and brush fires move so quickly that there can be no time for the homeowner to close all of the soffit vents of his or her home manually before fleeing the fire.

Soffit vents that automatically shut off airflow therethrough in the presence of heat caused by an outdoor fire also are known. Most of these vents employ various intumescent coatings and materials that expand when exposed to heat or flame to close off the vent. However, once the intumescent material is activated, the vent is destroyed and can no longer be used for attic ventilation. A homeowner must simply replace the vents following a nearby forest or brush fire, which is time consuming and expensive. Further, these types of automatically closing vents usually cannot be manually closed and reset by a homeowner if desired. This can be a problem in situations where the actual flames of a forest or brush fire are not close enough to activate the intumescent material, but glowing embers are nevertheless blown in the wind toward a home and become entrained in airflow through the soffit vent.

A need exists for an ember and flame resistant soffit vent that automatically closes off airflow through the vent when exposed to the heat of a flame very close to a home and that also can be manually closed by a homeowner if desired and later reopened and reset manually without destroying the automatic closing functionality of the vent. A further need exists for an ember and flame resistant soffit vent that is not destroyed after it is automatically closed by being exposed to the heat of a close flame. It is to the provision of an ember and flame resistant soffit vent that satisfies these and other needs that the present invention is primarily directed.

SUMMARY

Briefly described, an ember and flame resistant soffit vent includes a metal tray having ventilation openings formed through the floor of the tray. A stainless steel mesh screen is disposed on the floor of the tray covering its ventilation openings. A flat metal slide resides atop the mesh screen and has ventilation openings that match the ventilation openings in the floor of the tray. The slide can be slid within the tray from an open position wherein its ventilation openings align with those of the tray floor to allow ventilation and a closed position wherein the ventilation openings of the slide are misaligned with the openings of the tray floor to close off ventilation. The stainless steel screen helps prevent flying embers from entering an attic through the soffit vent, and the slide, when in its closed position, prevents heat and flames from entering the attic. An actuation tab allows a homeowner to move the slide manually between its open and closed positions.

In one embodiment, a first tension spring is attached at one end to an end wall of the tray and at its other end to the slide. A latch bar is fixed at one end to the opposite end wall of the tray and extends inwardly therefrom to a distal end. A linkage is attached at one end to the distal end of the latch bar and is attached at its other end to an end of a thermal link, creating a thermal link assembly. A second tension spring is attached at one end to the opposite end of the thermal link assembly and at its other end to the slide. The spring constant of the second tension spring is greater than that of the first tension spring so that the force of the second tension spring normally overcomes that of the first tension spring to hold the slide in its open position.

When the vent is exposed to the heat of a flame very close to the home, the thermal link breaks severing the spring biased link between the slide and the latch bar. This eliminates the force of the second spring that holds the slide in its open position and the first tension spring pulls the slide to its closed position. Thus, the vent closes automatically in the presence of heat from a nearby flame. If this occurs, the homeowner need not replace all of his or her soffit vents, but rather simply needs to replace the broken thermal link assemblies with inexpensive replacements.

If the homeowner wishes to close the soffit vents manually as a precaution in anticipation of a fire, the actuation tab of the slide is used to move the slide to its closed position. A latch mechanism such as detents in the latch bar releasably locks the slide in this closed position, but allows the slide to be moved manually back to its open position later. Manual closing and opening of the soffit vent in this way does not destroy the thermal link if it has not otherwise been broken by high heat. Thus, opening the soffit vent manually resets the vent to full functionality so that it can be manually or automatically closed as described.

In a second embodiment, only the first tension spring is used, and the latch comprises a latch base attached to the frame of the vent tray and a latch slide slidably attached to the latch base. One end of the latch slide is attached to a chain link of a thermal link assembly and a similar chain link at the other end of the thermal link assembly is attached to the vent slide. In this embodiment, the thermal link assembly, comprising the thermal link and chain links, normally resists the bias of the tension spring tending to move the vent slide automatically to its closed position. The vent can still be operated manually, however, by virtue of the two-piece sliding latch assembly. If the thermal link is severed by heat of a flame, the tension spring pulls the vent slide automatically to its closed position.

In a third embodiment, there is no chain link connected to the thermal link. In this embodiment, the thermal link is rigidly connected at one end to an end of the latch slide and rigidly connected at its other end to the vent slide. This embodiment functions similarly to the second embodiment, but there are no auxiliary chain links required to attach the thermal link within the soffit vent. Not only does this reduce manufacturing costs, it prevents the chain links from interfering with the operation of the soffit vent.

Thus, an ember and flame resistant soffit vent is disclosed that successfully addresses the problems and shortcomings of prior art vents and that provides additional features and advantages as well. The invention will be better understood upon review of the detailed description set forth below taken in conjunction with the attached drawing figures, which are briefly described as follows.

DETAILED DESCRIPTION

Figure 1:
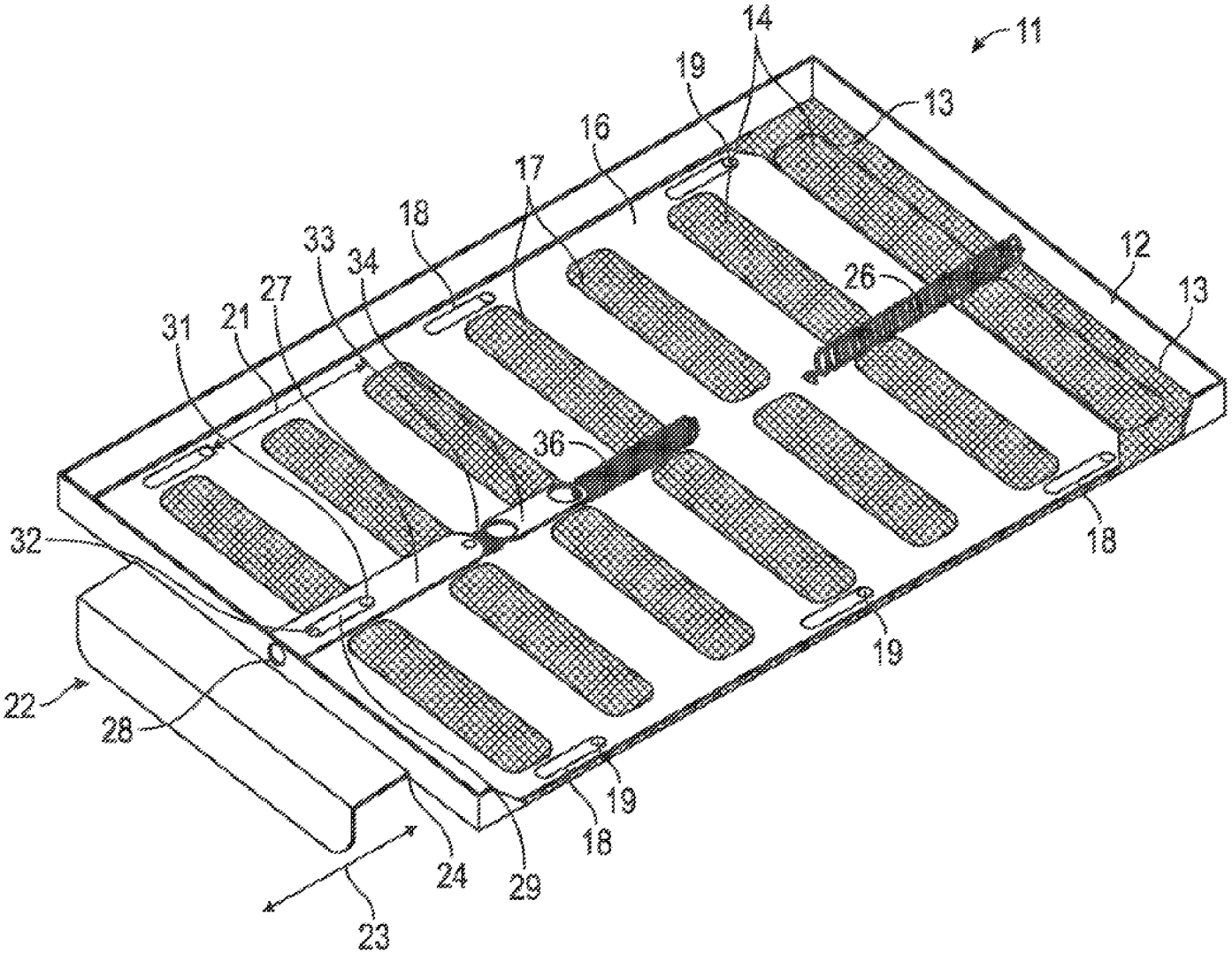
FIG. 1 is an orthogonal view from above of an ember and flame resistant resettable automatic soffit vent that embodies principles of the present invention in one example configuration.

Reference is now made to the drawing figures, wherein reference numerals indicate the parts of the invention. FIG. 1 shows one embodiment of an ember and flame resistant vent 11 having a rectangular metal tray 12 with a floor and four upstanding side walls. The upstanding side wall in the foreground in FIG. 1 is partially cut away to show better the various components of the vent 11. The floor of the tray is provided with an array of ventilation openings 13 that, in this embodiment, are rectangular and arranged in a 7 by 2 matrix. Of course, other arrangements of the ventilation openings are possible, and all should be construed to be within the scope of the invention. The ventilation openings allow airflow through the floor of the tray for admitting fresh air to an attic through a soffit to which the vent 11 is mounted.

A mesh screen 14 is disposed on the floor of the tray 12 overlying the ventilation openings therein. The mesh screen 14 preferably is formed of stainless steel and may have a mesh size between about 15 and 21, more preferably between about 17 and 19, and most preferably about 18. The wires of the stainless steel mesh screen may have a diameter between about 0.006 inch and 0.012 inch and most preferably about 0.009 inch. A stainless steel mesh screen having these characteristics has been shown to be effective to prevent airborne embers from a nearby fire from entering the attic through the soffit vent. The stainless steel screen is also highly resistant to rust and corrosion that otherwise might degrade the performance of the screen over time.

A flat metal slide 16 is disposed atop the wire mesh 14 within the tray 12. The slide 16 has a width slightly less than the width of the tray floor. It has a length sufficiently less than the length of the floor so that the rightmost end of the slide does not cover the two rightmost ventilation openings 13 in the floor when the slide is in the position shown in FIG. 1. A 6×2 array of rectangular ventilation openings 17 are formed through the slide. The ventilation openings are substantially the same size as those formed through the floor of the tray. Further, they are arranged so that each ventilation opening 17 of the slide aligns with a corresponding ventilation opening in the floor of the tray 12 when the slide is in the position shown in FIG. 1. It will thus be seen that when the slide is in this position, ambient air may flow freely through the aligned openings in the floor of the tray and in the slide to ventilate an attic space. This position is referred to as the open position of the slide.

The slide is formed with a plurality of slots 19 along its edges. The slide is loosely secured to the floor of the tray 12 by corresponding rivets 19 that extend through the slots 19, through the mesh screen 14, and through holes in the floor of the tray 12. An actuation tab 22 of the slide 16 extends through a slot 24 in the left upstanding wall of the tray. With this arrangement, it will be appreciated that the slide 16 can be moved or slid to the right in FIG. 1 by urging the actuation tab 22 to the right.

As the slide is moved to the right, the stationary rivets 19 move along the slots 18 to keep the slide aligned and attached to the tray 12. The ventilation openings 17 of the tray progressively misalign with and, when the slide is moved fully to the right, close off airflow through the ventilation openings 13 in the floor of the tray 12. This is referred to as the closed position of the slide. The slide 16 can be moved between its open and closed positions as indicated by arrow 21 by moving the actuation tab 22 as indicated by arrow 23.

A first tension spring 26 is attached at one end to the right upstanding wall of the tray 12 and extends across the top of the slide 16 to where its opposite end is attached to the slide. The first tension spring thus continually biases the slide 16 to its closed position. An elongated latch bar 27 is attached with a rivet 28 to the left upstanding end wall of the tray and extends inwardly therefrom. A slot 29 is formed in the latch bar and terminates at its right end in FIG. 1 in a dimple or detent 31. A latch pin 32 is attached to the slide 16 and extends upwardly therefrom through the slot 29.

When the slide is in its open position as illustrated in FIG. 1, the latch pin 32 resides at the left end of the slot as shown. However, as the slide 16 is slid to the right, the latch pin moves along the slot 29 until ultimately engaging and becoming lodged in the detent 31. The latch pin 32 and detent 31 interact to form a mechanical latch that secures the slide 16 in its closed position. When the slide is forced back to its open position by urging the actuation tab 22 to the left, the latch pin and detent disengage to allow the movement.

A linkage 33 is attached at one end to the distal end of the latch bar 27 and its other end connects to one end of a fusible link device 34. The fusible link 34 is attached at its other end to one end of a second tension spring 36, and the opposite end of the second tension spring is fixed to the slide 16 as shown. The spring constant of the second tension spring 36 is somewhat greater than that of the first tension spring 26. The second tension spring 36 therefore normally overcomes the bias of the first tension spring 26 and thereby holds the slide in its open position during normal conditions. The vent 11 still can be manually closed by urging the actuation tab to the right until the latch pin 32 engages with the detent 33 and manually re-opened by urging the actuation tab to the left.

The thermal link 34 is a common item available inexpensively from companies such as Dayton and Grainger (www.grainger.com). The device has two halves fused together by a solder or other fusing material that melts when exposed to a predetermined temperature. When exposed to this temperature, the fusing material melts and the two halves of the fusible link disengage and separate to break the link. Other types of fusible links are available, but all perform the function of breaking apart when exposed to a predetermined set temperature.

For the present invention, it is preferred that the predetermined set temperature be between about 125° F. and about 205° F., more preferably between about 155° F. and 175° F., and most preferably about 165° F. The predetermined temperature is higher than any ambient temperature that will be encountered, but is sufficiently low that the temperature is reached quickly in the event of a fire that is very close to a home.

When the vent 11 is attached to the soffit of a home and in its open position shown in FIG. 1, it functions as does any soffit vent to allow fresh airflow through the vent and into the attic to replace hot air expelled from the attic elsewhere. In the event of a nearby forest fire or brush fire that produces hot glowing embers that drift on the wind, the stainless steel mesh screen 14 encounters embers that may become entrained in the airflow through the vent and the embers are prevented from entering the attic. Airflow, however, is still able to enter the attic for ventilation purposes.

If a homeowner suspects that a wildfire is approaching his or her home, the vent 11 can be closed manually by reaching up, perhaps with a pole, and sliding the actuation tab to the right in FIG. 1. The latch pin and detent engage to hold the slide in its closed position blocking airflow as well as heat, flame, and embers from entering through the vent. When the homeowner returns after the fire threat is abated, the vents can be reopened manually by urging the actuation tab 22 back to the left until the latch pin disengages from the detent. Assuming the vent was not exposed to temperatures above the predetermined temperature of the thermal link during the threat, the slide returns to its open position with the fusible link intact. In this way, the vent is reset in preparation for the next fire threat.

Finally, in the event that flames from a wildfire become near enough to a home so that they raise the temperature at the soffits above the predetermined temperature, preferably about 165° F., the automatic closing feature of the soffit vent is actuated. Specifically, the thermal link 34 breaks apart due to the heat. The force of the second tension spring 36, which holds the slide 16 in the open position, is released and the first tension spring 26, now unopposed by the second tension spring, pulls the slide 16 to its closed position. Of course, the thermal link 34 is destroyed and the automatic closing feature is disabled. However, unlike prior art vents that use intumescent materials, the entire vent need not be replaced. Only the thermal link, which is an inexpensive part, need be replaced to restore full functionality to the vent.

Figure 2:
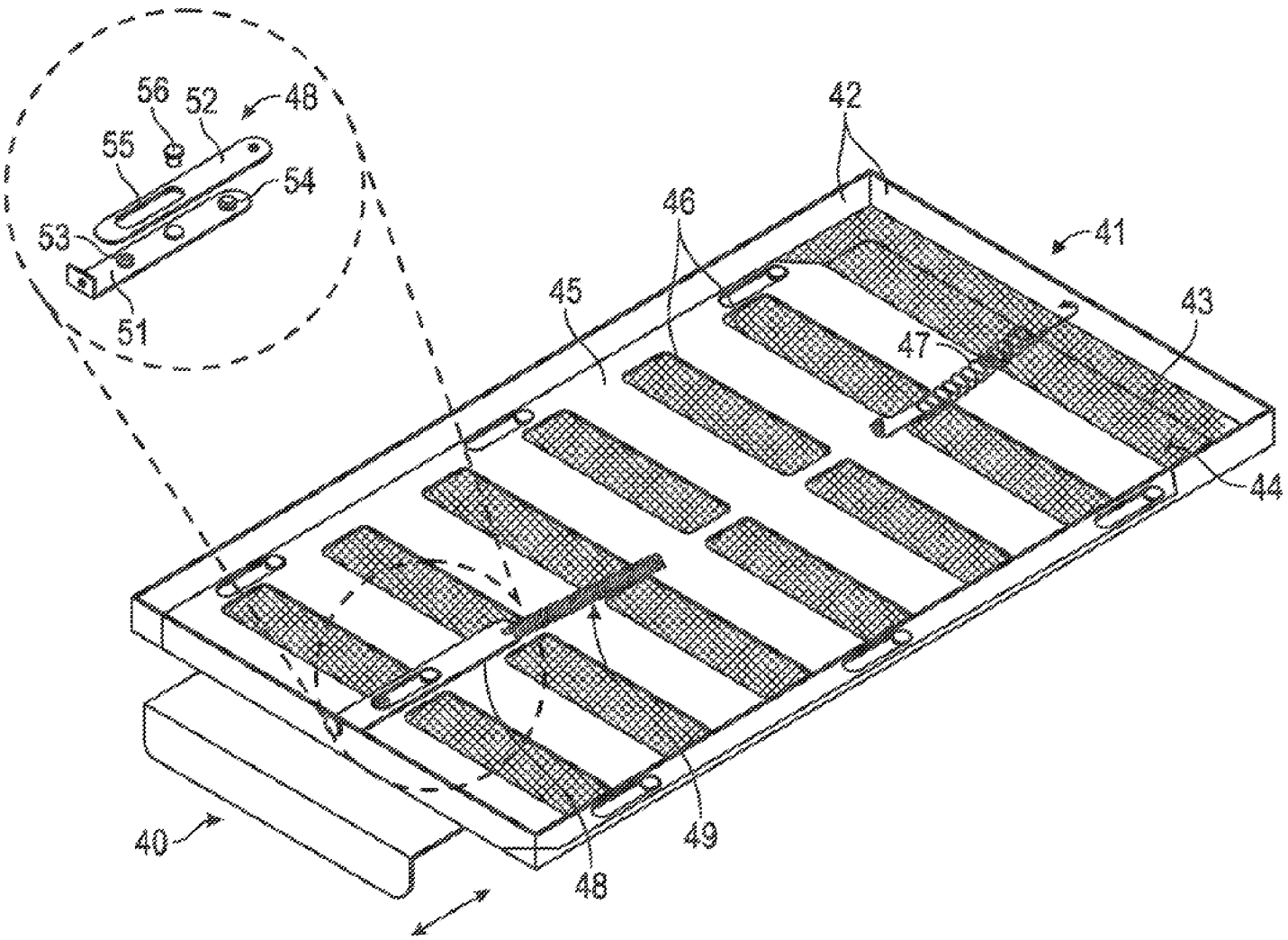
FIG. 2 is an orthogonal view from above of an ember and flame resistant resettable automatic soffit vent that embodies principles of the present invention in a second example configuration.

FIG. 2 illustrates an alternate embodiment of the invention in which a single tension spring, a two-piece sliding latch, and a thermal link assembly obtain the same functionality as the prior embodiment. The embodiment of FIG. 2 is the same as that of FIG. 1 in many respects. Specifically, the vent tray 41, sides 42, openings 43, screen 44, slide 45, openings 46, and tension spring 47 are the same as in the embodiment of FIG. 1. The embodiment of FIG. 2 includes a resettable latch assembly 48 that includes a latch base 51 attached to the vent frame and a latch slide 52 slidably mounted to the latch base 51.

The latch slide is mounted by means of a latch fastener 56 that extends through a slot 55 of the latch slide 52. The latch base includes a projecting "open" detent 53 and a projecting "closed" detent 54. With this embodiment, it will be seen that the latch slide 52 can move longitudinally relative to the latch base 51 a distance equal to the length of the slot 55 between open and closed positions. When in the open position, the "open" detent extends into the slot 55 and holds the latch slide in that position and the "closed" detent extends into the slot 55 and performs that function when the latch slide is in the closed position.

A thermal link assembly 49, which may include a thermal link with attachment chains or chain links on each end, is attached at one end to the end of the latch slide and at its other end to the vent slide 45 as shown. Under normal conditions as shown in FIG. 2, the thermal link assembly 49 resists the force of the tension spring 47 trying to pull the vent slide 45 to its closed position. However, the vent slide can still be moved manually between its open position and its closed position using the actuation tab 40. When the actuation tab 40 is urged manually to the right in FIG. 2, the vent slide 45, thermal link assembly 49, and latch slide 52 all move to the right allowing movement of the vent slide. When the actuation tab 40 is urged to the left in FIG. 2, these components all move to the left allowing the vent slide to move to its open position. In the open position of the vent, the "open" detent on the latch base engages in the left end of the slot 55 to hold the vent slide in its open position against the bias of the tension spring 47.

In the event of flames close to the home, the temperature at the vent eventually reaches the set temperature of the thermal link, preferably 165° F., which separates the thermal link thereby severing the connection between the latch 48 and the vent slide 45. This eliminates the only thing holding the vent slide open against the bias of tension spring 47. As a result, the tension spring 47 pulls the vent slide 45 quickly to its closed position to close off airflow through the vent. As with the first embodiment of FIG. 1, this prevents heat and flames from entering the attic space through the soffit vents of a home. In the event of an automatic closure such as this, the thermal link assembly and thus the automatic closing feature of the vent are destroyed. However, the homeowner need only remove the spent thermal link assemblies of his or her soffit vents and replace them with inexpensive replacements to restore full functionality to the soffit vents.

Figure 3:
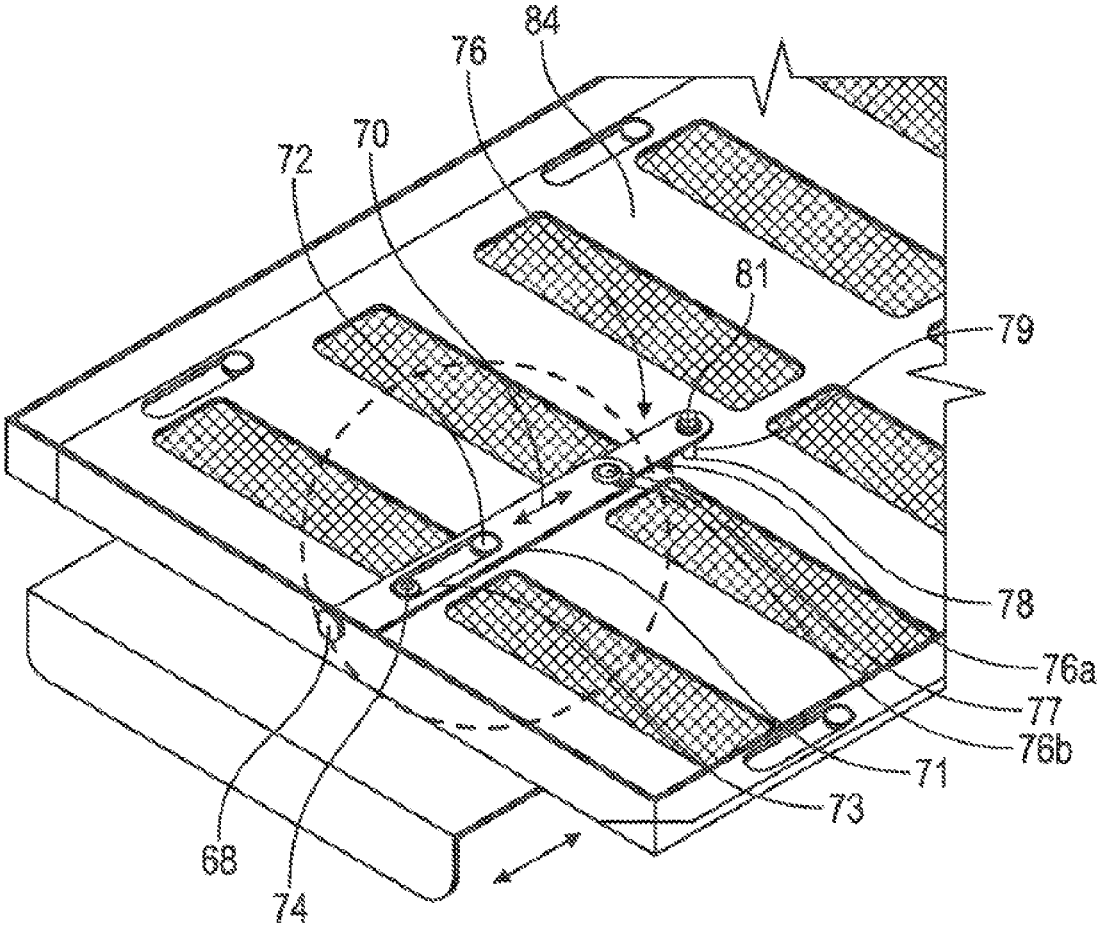
FIG. 3 is an enlarged orthogonal view of a portion of an ember and flame resistant resettable automatic soffit vent incorporating resettable latch and thermal link assemblies that exemplify principles of the invention and a third embodiment.

FIG. 3 illustrates yet another alternate embodiment of the invention in which a single tension spring, a two-piece sliding latch assembly, and a rigidly secured thermal link obtain functionality similar to that of the prior embodiments. FIG. 3 is an enlarged view of the sliding latch assembly and the thermal link. All other features of the soffit vent are the same as in prior embodiments and need not be described again here. In this embodiment, a sliding latch assembly 71 includes a latch base attached at one end to an end wall of the vent frame via fastener 68. A latch slide 70 is mounted atop the latch base by a latch fastener 72 that extends through an elongated slot 73 in the latch slide and is secured to the latch base. An "open" detent 74 is formed in the latch base and extends through the slot at one end when the vent is in the open position. The "open detent" prevents the vent from closing under normal circumstances after it has been manually opened.

A thermal link 76 is rigidly mounted at one end to the inboard end of the latch slide by means of a fastener 77, which preferably is a removable fastener such as a nut and bolt. The other end of the thermal link is rigidly mounted to the vent slide 84 by means of a fastener 78. The fastener 78 may have a standoff portion 79 and a threaded portion 81 onto which a nut can be threaded to secure the other end of the thermal link 76 securely but removably to the fastener 78 and thereby to the vent slide 84. The soffit vent is shown in FIG. 3 in its open position with the actuation tab pulled to the left and with the openings in the vent slide aligned with the openings in the vent tray. The "open" detent 74 is lodged in the left end of slot 73, thereby holding the vent slide open. Pressing the actuation tab to the right overcomes the hold of the "open" detent and allows the soffit vent to be closed manually.

Figure 4:
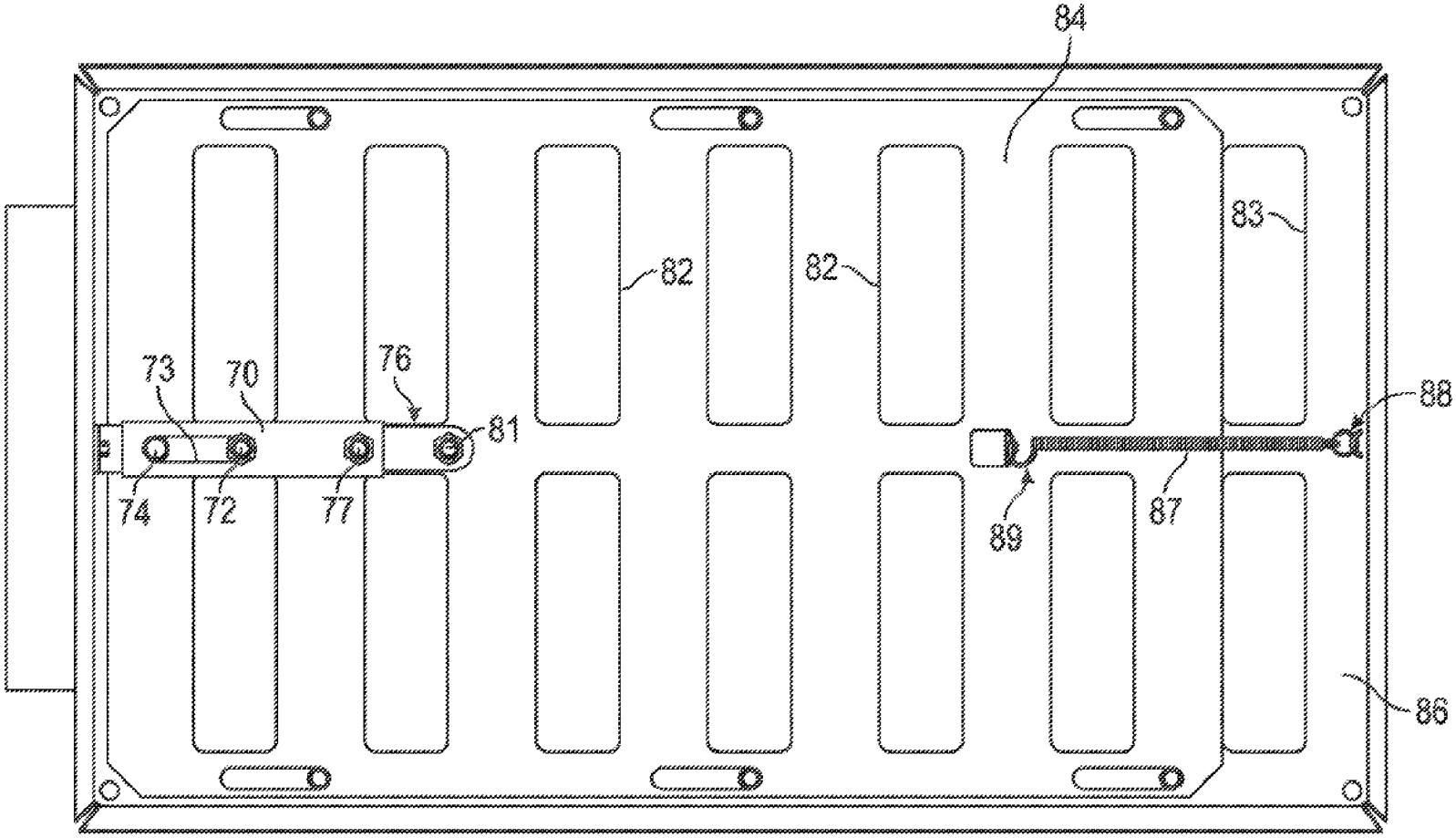
FIG. 4 is a top plan view of a soffit vent incorporating the latch and thermal link assemblies of FIG. 3 shown in the manually open position with thermal link intact.

FIG. 4 shows the soffit vent of this third embodiment in the open configuration in which it appears under normal circumstances for ventilating an attic space above. As in prior embodiments, tension spring 87 is attached at one end 88 to the vent frame and at its other end 89 to the vent slide 84. The tension spring constantly tries to pull the vent slide to its closed position. The sliding latch and thermal link assemblies are shown at the other end of the vent. Since the soffit vent is open in this view, the vent slide is moved to its leftmost position and its openings 82 are aligned with the openings 83 of the vent tray below. The "open" detent is shown lodged in the leftmost end of slot 73 such that the detent holds the vent slide open against the bias of tension spring 87.

Figure 5:
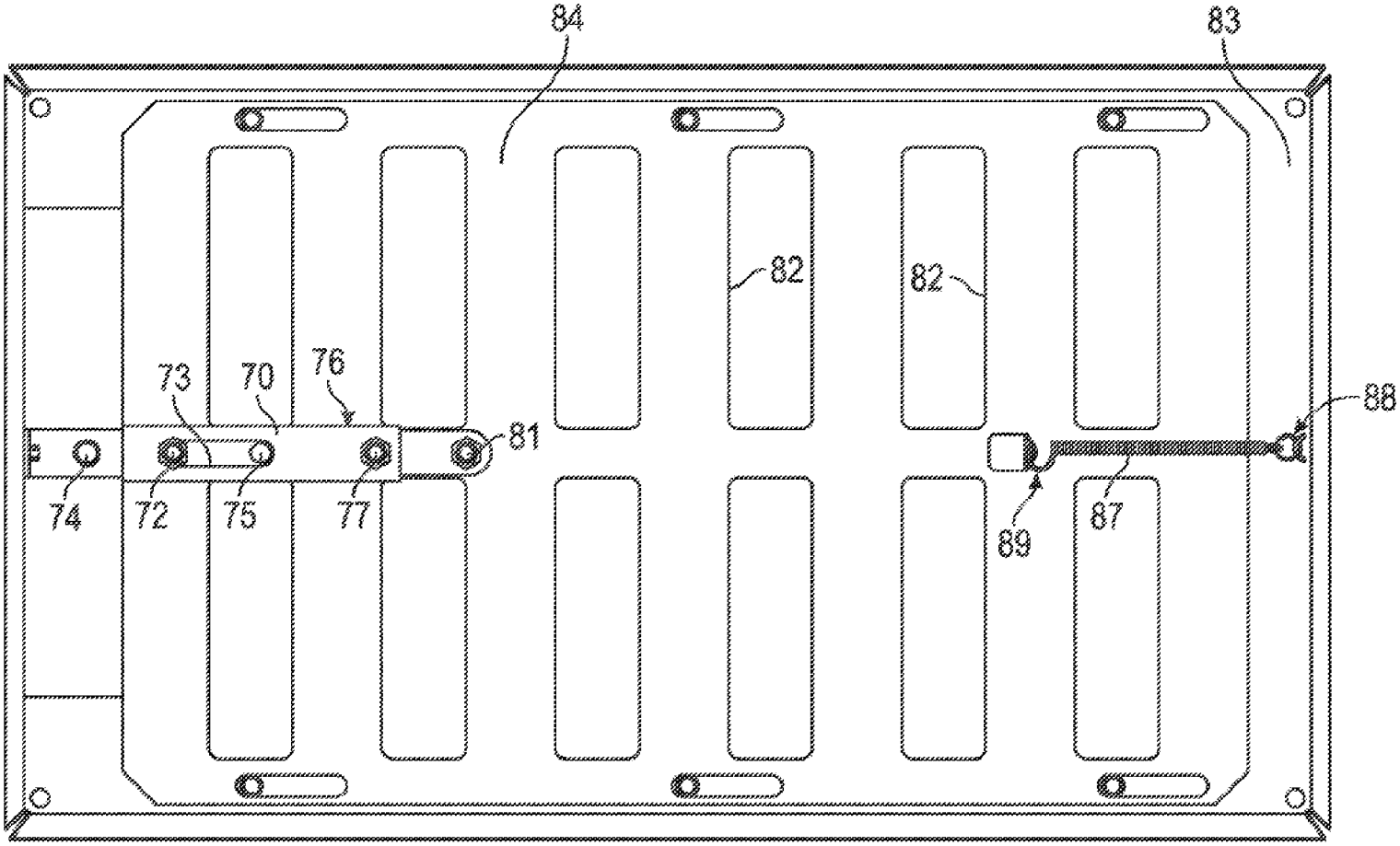
FIG. 5 is a top plan view of a soffit vent incorporating the latch and thermal link assemblies of FIG. 3 shown in the manually closed position with thermal link intact.

If a homeowner is concerned about an approaching forest fire, he or she may decide to close the soffit vents around his or her home as a precaution. As described above, to do this, the actuation tabs of the vent slides are urged toward the vent trays of the vents with a hand or long implement. This, in turn, causes the rigidly mounted thermal link 76 to pull on the latch slide 70 so as to urge it to the right in FIG. 5. Eventually the holding force of the "open" detent is overcome so that the vent slide is free to move to the closed position depicted in FIG. 5. In this regard, once the force of the "open" detent is overcome, the tension spring 87 pulls the vent slide, thermal link, and attached latch slide to the right in FIG. 5. When the vent slide is fully closed, the latch fastener 72 lodges or clicks in the right end of the slot 73 to define the limit of movement. A "closed" detent 75 may be formed in the latch base to register within the other end of the slot in the closed position of the soffit vent as an indicator that the vent is fully closed.

After the fire danger passes, the homeowner will want to open his or her soffit vents again to resume attic ventilation. To do this, the actuation tabs are simply pulled away from the vents with a hand or long implement. This moves the vent slide to its open position (FIG. 4) allowing ventilation. The "open" detent clicks into the end of the slot to hold the vent open until it is next desired to close the vent.

Figure 6:
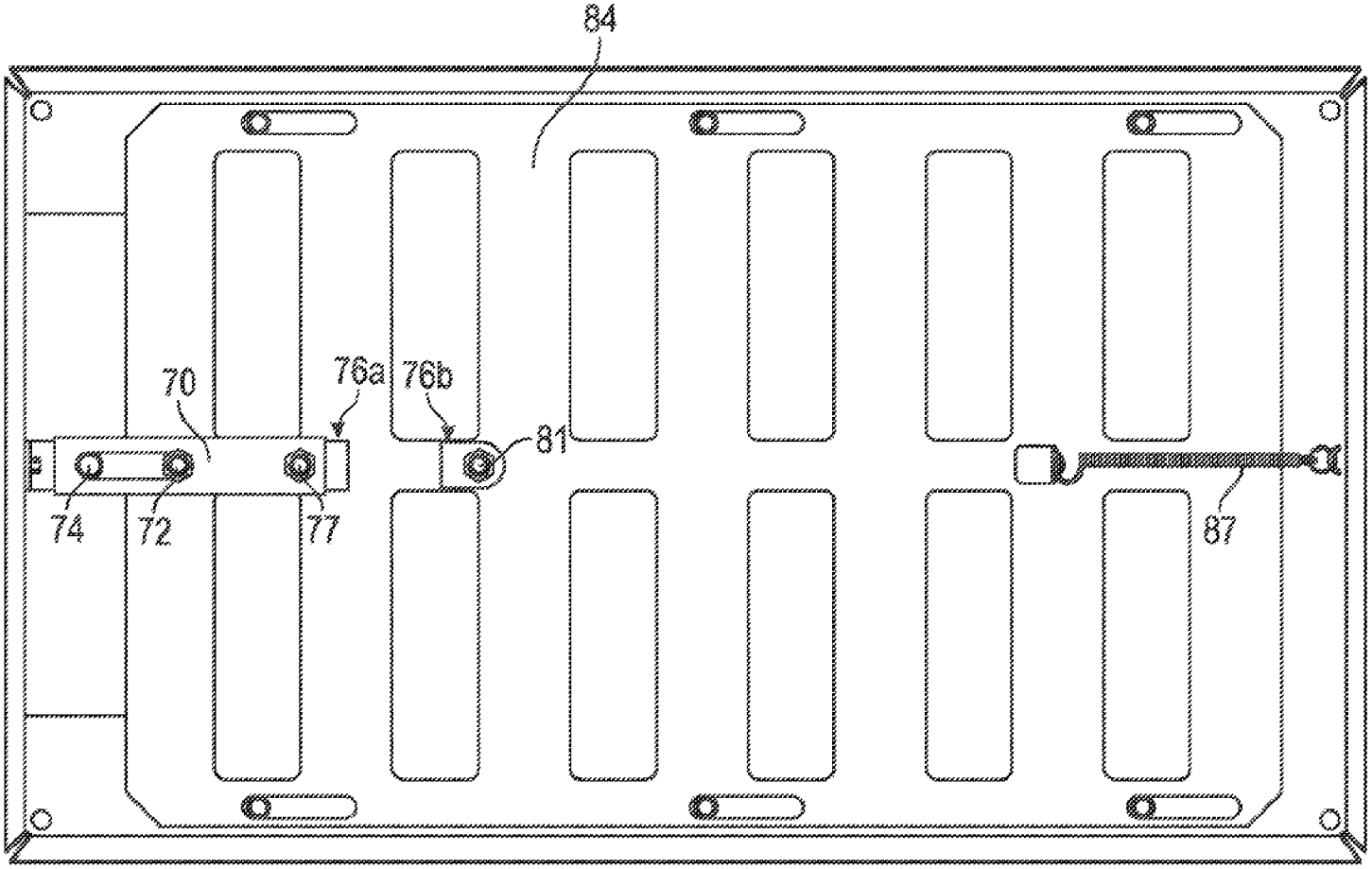
FIG. 6 is a top plan view of a soffit vent incorporating the latch and thermal link assemblies of FIG. 3 shown in the automatically closed position with the thermal link broken after having been exposed to heat.

FIG. 6 illustrates the condition of the soffit vent after it has closed automatically following exposure to the heat of close-by flames. As flames approach close to a home with the soffit vents open, the temperature in the vicinity of the soffit vents progressively rises. At some point, this temperature becomes higher than the set temperature of the thermal link, at which point the thermal link breaks apart as it is designed to do into segments 76*a* and 76*b*. This, in turn, severs the mechanical connection between the vent slide 84 and the latch assembly. With nothing left to hold the vent slide in its open position, the tension spring 87 pulls the vent slide 84 to the right in FIG. 6 until it is in its closed position. In this way, the vent reacts automatically to the heat of a nearby fire to close itself and thereby to prevent embers, flames, and heat from entering the attic space above.

Once the thermal link is severed, the soffit vent can no longer be manually opened. To restore the vent to functional condition, a homeowner need only purchase a low-cost replacement thermal link, remove the spent thermal link, and replace it with the replacement thermal link. This is why the fasteners 77 and 81 most preferably are removable fasteners. With the spent thermal link replaced, the soffit vent is restored to full functionally and can be opened and closed manually and will close itself automatically in the event of a close-by fire.

The invention has been illustrated and described herein in terms of preferred embodiments considered by the inventors to represent the best modes of carrying out the invention. However, the preferred embodiments are illustrative only and not intended to limit the scope of the invention. A wide gamut of additions, deletions, and modifications, both subtle and gross, may be made to the illustrative embodiments without departing from the spirit and scope of the invention itself. For example, the vent need not be rectangular in shape. The invention encompasses, for instance, a round vent with a round slide that rotates about its center to open and close airflow through the vent. The mesh screen need not be between the floor of the tray and the slide, but can be otherwise configured and/or located as long as it spans the ventilation openings of the tray. For example, individual screen meshes may be attached to the tray floor with each covering a corresponding ventilation opening.

The preferred materials of the various components may be replaced with other materials that provide the same function in an equivalent way. For instance, the stainless steel mesh screen may be replaced with a copper or aluminum screen if desired. While envisioned as a soffit vent, the inventive features of the vent also can be incorporated into ridge vents or other outflow attic ventilation devices. In this way, the entire attic of a home can be closed off automatically and/or manually when a forest or brush fire approaches. These and other changes to the illustrated embodiment may be envisioned by the skilled artisan, and all such changes are intended and should be construed to fall within the scope of the invention.

What is claimed is:

1. A vent comprising:

a main body;

a plurality of ventilation openings formed through the main body;

a slide configured to be movable along the main body between an open position allowing airflow through the plurality of ventilation openings and a closed position substantially preventing airflow through the plurality of ventilation openings;

a first spring connected to a first end of the slide and configured to apply a biasing force to bias the slide toward the closed position; and a second spring connected to a second end of the slide and configured apply to a holding force to hold the slide in an open condition against the biasing force;

wherein the first and second springs each comprise a tension spring having one end connected to the main body and another end connected to the slide;

wherein the holding force applied by the second spring is greater than the biasing force of the first spring so as to hold the slide in the open position;

wherein the slide is configured to be manually moveable between the open and closed positions by a user, to be automatically moveable between the open and closed positions, or a combination thereof.

2. The vent of claim 1, further comprising a thermal link assembly coupled at a first end to a wall of the main body, and at a second end to the second spring.

3. The vent of claim 2, wherein the thermal link is configured to break apart when a temperature at the vent is at or above a predetermined temperature to release the holding force applied by the second spring and allow the biasing force applied by the first spring to move the slide toward the closed position to substantially prevent airflow through the plurality of ventilation openings.

4. The vent of claim 1, further comprising a plurality of ventilation openings formed through the slide, wherein the ventilation openings formed through the slide are configured to align with the ventilation openings formed through the main body when the slide is in its open position, and misalign with the ventilation openings formed through the slide with the ventilation openings formed through the main body when the slide is in its closed position.

5. The vent of claim 1, further comprising a latch bar assembly having a first end connected to the main body and a second end; and a thermal link assembly connected to the second end of the latch bar assembly and to the second spring; wherein the thermal link is configured to break apart when a temperature at the vent is at or above a predetermined temperature.

6. The vent of claim 5, wherein the latch bar assembly further comprises a latch base secured to the main body and a latch slide slidably coupled to the latch bar; wherein the thermal link assembly comprises a thermal link attached to the latch slide and to the slide;

and wherein the slide can be manually moved between the open and closed positions while the thermal link remains attached to the latch slide and the slide.

7. The vent of claim 1, wherein the slide comprises an actuation tab that extends beyond the main body, and wherein the actuation tab is configured to enable the user to move the slide manually between the open and closed positions.

8. The vent of claim 1, further comprising a screen overlying the ventilation openings and configured to deter passage of embers through the vent.

9. A soffit vent comprising:

a main body having a floor and a plurality of walls;

a plurality of ventilation openings formed through the floor of the main body and configured to allow an airflow through the soffit vent;

a slide received within the main body and configured to be moveable along the floor of the main body;

a biasing structure configured to bias the slide toward a closed position in which airflow through the through the plurality of ventilation openings is substantially blocked; and a holding structure configured to hold the slide in an open position;

wherein the biasing structure comprises a first spring coupled to a first end of the slide, and the holding structure comprises a second spring coupled to a second end of the slide;

wherein the second spring comprises a spring constant that is greater than a spring constant of the first spring so as to maintain the slide in the open position;

wherein the slide is configured to be manually moveable between the open and closed positions by a user.

10. The soffit vent of claim 9, wherein the holding structure comprises a thermal link connected to one of the walls of the main body and to the second spring; wherein the thermal link is configured to break apart when a temperature at the soffit vent rises above a predetermined threshold to allow the biasing structure to move the slide toward the closed position.

11. The soffit vent of claim 9, wherein the holding structure comprises a thermal link connected to the second spring, a latch bar assembly connected at a first end to at least one wall of the main body and at a second end to the thermal link.

12. The soffit vent of claim 11, wherein the latch bar assembly comprises a fixed latch base secured to the at least one wall of the main body and a latch slide slidably secured to the fixed latch base; and wherein the second spring is configured to enable the slide to be manually moved between the open and closed positions while the thermal link assembly remains intact.

13. The soffit vent of claim 12, wherein one of the fixed latch base and the latch slide is formed with a slot and at least one of the fixed latch base and the latch slide is formed with a latch fastener that extends through the slot such that the latch fastener moves along the slot as the latch slide moves relative to the fixed latch base.

14. The soffit vent of claim 9, wherein the holding structure further comprises a latch bar assembly connected at a first end to at least one wall of the main body and at a second end to a thermal link coupled to the second spring; wherein the thermal link is configured to break apart when a temperature at the soffit vent rises above a predetermined threshold to disengage the holding structure from the slide and allow the biasing structure to move the slide toward the closed position.

15. The soffit vent of claim 9, wherein the first and second springs each comprise a tension spring having one end connected to a wall of the main body and another end connected to the slide.

16. The soffit vent of claim 9, further comprising a screen overlying the ventilation openings and configured to deter passage of embers through the soffit vent.

17. A vent comprising:

a main body;

a plurality of ventilation openings formed through the main body;

a slide configured to be movable along the main body between an open position allowing airflow through the plurality of ventilation openings and a closed position substantially preventing airflow through the plurality of ventilation openings;

a biasing structure configured to urge the slide toward the closed position; and a holding structure configured to urge the slide toward the open position;

wherein the slide comprises an actuation tab that extends beyond the main body, and wherein the actuation tab is configured to enable a user to move the slide manually between the open and closed positions.

18. The vent of claim 17, wherein the biasing structure comprises a first spring coupled to an end of the slide, and the holding structure comprises a second spring coupled to a second end of the slide; and wherein the second spring comprises a spring constant that is greater than a spring constant of the first spring so as to maintain the slide in the open position.

19. The vent of claim 17, wherein the holding structure comprises a thermal link, a latch bar assembly connected at a first end to at least one wall of the main body and at a second end to the thermal link, and a spring extending between the slide and the thermal link.

20. The vent of claim 19, wherein the latch bar assembly comprises a fixed latch base secured to the at least one wall of the main body and a latch slide slidably secured to the fixed latch base; and wherein the spring is configured to enable the slide to be manually moved between the open and closed positions while the thermal link assembly remains intact.

21. The vent of claim 17, wherein the holding structure comprises a thermal link is configured to disengage the holding structure from the slide and allow the biasing structure to move the slide toward the closed position when a temperature at the vent rises above a predetermined threshold.

* * * * *